US006412982B1

(12) United States Patent
Park

(10) Patent No.: US 6,412,982 B1
(45) Date of Patent: Jul. 2, 2002

(54) HIGH GROUND PRESSURE ELASTIC SUPPORT

(75) Inventor: Young-Sun Park, Seoul (KR)

(73) Assignee: Hyup Sung Industrial Co., Ltd., Kyunggi-Do (KR)

( * ) Notice: Subject to any disclaimer, the term of this patent is extended or adjusted under 35 U.S.C. 154(b) by 0 days.

(21) Appl. No.: 09/555,410

(22) PCT Filed: Sep. 30, 1999

(86) PCT No.: PCT/KR99/00593

§ 371 (c)(1),
(2), (4) Date: Jul. 31, 2000

(87) PCT Pub. No.: WO00/19020

PCT Pub. Date: Apr. 6, 2000

(30) Foreign Application Priority Data

Sep. 30, 1998 (KR) ..... 98/18788

(51) Int. Cl.[7] ..... F16C 41/00; F16C 27/00
(52) U.S. Cl. ..... 384/36; 384/36; 14/73.5
(58) Field of Search ..... 384/36, 37; 14/73.5

(56) References Cited

U.S. PATENT DOCUMENTS 3,728,752 A * 4/1973 Andra et al. ..... 14/73.5
3,782,789 A * 1/1974 Koester et al. ..... 14/73.5
3,806,975 A * 4/1974 Fyfe ..... 14/73.5
3,921,240 A * 11/1975 Fyfe ..... 14/73.5
3,934,295 A * 1/1976 Koster et al. ..... 14/73.5
3,998,499 A * 12/1976 Chiarotto ..... 384/36
4,006,505 A * 2/1977 Koster et al. ..... 384/36
4,259,759 A * 4/1981 Tada ..... 14/73.5
4,695,169 A * 9/1987 Baigent ..... 384/36
4,928,339 A * 5/1990 Klawe ..... 384/36

FOREIGN PATENT DOCUMENTS

JP 3-42088 9/1991

* cited by examiner

*Primary Examiner*—Paul N. Dickson
*Assistant Examiner*—Robert A. Siconolfi
(74) *Attorney, Agent, or Firm*—Anderson Kill & Olick; Eugene Lieberstein; Michael N. Meller

(57) ABSTRACT

There is provided an elastomeric bearing installed at an upper girder of a bridge or between upper and lower parts of a building, for supporting a load in a stable manner. The elastomeric bearing includes a cylinder member having a plurality of cylindrical hollows, elastomeric members seated on the respective cylindrical hollows of the cylinder member, a plurality of pistons inserted into the respective cylindrical hollows of the cylinder member to hermetically seal the elastomeric members seated thereon, and elasticity reinforcement elements integrally formed with the cylinder member and the plurality of pistons, for accommodating the same, the cylinder member having a plate-shaped body and a plurality of cylinders having cylindrical hollows formed therein, the plurality of cylinders protruding from the bottom of the body. Since buckling occurs only in one direction while supporting a higher load by constricting expansion, the safety can be enhanced. Also, in a state where the height of the elastomeric pad is fixed, the moving distance of the upper plate can be secured. Further, the width of the elastomeric bearing itself can be reduced, thereby reducing the construction cost.

1 Claim, 6 Drawing Sheets

HIGH GROUND PRESSURE ELASTIC SUPPORT

BACKGROUND OF THE INVENTION

1. Field of the Invention

The present invention relates to an elastomeric bearing installed at an upper girder of a bridge or between upper and lower parts of a building, for supporting a load in a stable manner, and more particularly, to an elastomeric bearing for supporting a high load, which can enhance stability, while supporting a higher load, and which can reduce the construction cost by reducing its own width.

2. Description of the Related Art

A conventional elastomeric bearing 100, as shown in FIG. 7, includes an upper plate 200, a lower plate 300 and an elastomeric pad 110 disposed therebetween. The elastomeric pad 110 includes a body 11 made of rubber and a plurality of reinforcement plates 112 inserted into the body 111 to be parallel in a horizontal direction.

The elastomeric pad 110 is directly installed as a single member so as to allow buckling or sliding while supporting an upper load of a girder or building. Alternatively, occasionally, the elastomeric bearing 100 shown in FIG. 7 is advantageously used in order to control buckling or sliding of the elastomeric pad 110 in a predetermined direction or at a predetermined angle. Here, the directions of movement of the elastomeric pad 110 are controlled by installing stoppers, guides, clamps or the like at the upper plate 200 and the lower plate 300 so as to correspond to each other, thereby suppressing buckling or sliding of the elastomeric pad 110. This technology is known well and a detailed explanation thereof will not be made.

Since the body 111 of the elastomeric pad 110 is made of rubber, buckling or sliding occurs within the elastomeric pad I 10 due to physical properties of rubber at a predetermined angle according to the direction of a load applied. Also, since the elastomeric pad 110 includes a plurality of reinforcement plates 112, excessive deformation due to compression can be prevented. Further, if an excessive horizontal load is applied like in the event of the earthquake, the work energy is turned into the deformation energy of the rubber body 111, thereby reducing a shock due to the horizontal load. Thus, the elastomeric pad 110 must be designed so as to operate properly with an ultimate strength of rubber. Also, the elastomeric pad 110 must accommodate a temporary overload or deformation greater than a design load without being destroyed.

If a load is applied to the conventional elastomeric pad 110, the deformation(expansion) of the body 111 incorporating reinforcement plates 112 is somewhat suppressed. However, the body 111 between the reinforcement plates 112 may undergo expansion in every direction, that is, susceptible to deformation, thereby degrading durability and a load-supporting stress. Thus, there is a limit in improving stability while supporting a high load. Also, since the height of an elastomeric pad is proportional to the moving distance of the upper plate of a bridge, various types of elastomeric pads must be fabricated according to the moving distances of the upper plates of various bridges.

Thus, an elastomeric bearing (or elastomeric pot) shown in FIG. 8 has been proposed and used. According to the proposed elastomeric bearing, an elastomeric bearing 100 includes an upper plate 200, a lower plate 300 having a cylindrical hollow 310, and an elastomeric pad 120. The elastomeric pad 120 includes an elastomeric member 121 made of rubber and seated in the cylindrical hollow 310 of the lower plate 300, a piston 122 inserted into the cylindrical hollow 310 to be elastically supported upwardly by the elastomeric member 121, a sliding plate 123 fixed on the top surface of the piston 122, for allowing smooth sliding of the upper plate 220, and sealing means fixed to the piston 122, for sealing the elastomeric member 121 seated in the cylindrical hollow 310. Here, the sliding plate 123 is generally made of polytetrafluoroethylene (PTFE) resin.

The elastomeric pad 120 cannot be used as a single member in view of its structure and is necessarily used in the elastomeric bearing 100 reinforced with the upper plate 200 and the lower plate 300.

The elastomeric bearing 100 may be embodied in various types as necessary. For example, an omni-directionally movable elastomeric bearing is shown in FIG. 8. In the case of an omni-directionally fixed elastomeric bearing, the sliding plate 123 is removed, and the upper plate 200 and the piston 122 of the elastomeric pad 120 are integrally formed, thereby preventing the upper plate 200 from sliding in every direction, by means of the piston 122 inserted into the cylindrical hollow 310. Also, in the case of a uni-directionally movable elastomeric bearing, guide grooves are formed at the upper plate 200 and/or the piston 122 in one direction, and separate guide pins are inserted into the guide grooves or guide pins are installed at the upper plate 200 or the piston 122 positioned at locations corresponding to the guide grooves, thereby allowing the upper plate 200 to slide in one direction along the guide grooves.

When a vertical load is applied to the elastomeric bearing 100 having the elastomeric pad 120, the piston 122 sways in every direction so that it is buckled in every direction like the elastomeric bearing 100 shown in FIG. 7.

In the elastomeric bearing 100 shown in 8, since the elastomeric member 121 is sealed on the cylindrical hollow 310 of the lower plate 300, a vertical load is applied to the elastomeric bearing 100 so that expansion does not occur even if the elastomeric member 121 is pressed. Therefore, the elastomeric bearing 100 shown in FIG. 8 is safer than the elastomeric bearing 100 having the elastomeric pad 110 shown in FIG. 7, while supporting a higher load.

In the elastomeric bearing 100 shown in FIG. 8, since the cylindrical hollow 310, the elastomeric member 121 and the piston 122 are circular in terms of their mechanical structures, in the case where the size of the elastomeric bearing 100 is increased for the purpose of supporting a higher load, the diameter and depth of the cylindrical hollow 310 and the width of the lower plate 300 having the cylindrical hollow 310 are increased by predetermined increment based on the Hoop's formula which is well known in the art.

The length of a beam or truss constituting a girder is tensile or elastic due to its tare, external force or a change in the temperature. Thus, in order to support the beam or truss constituting a girder, an appropriate edge distance is required considering safety.

In the case of supporting a beam or truss constituting a girder using the elastomeric bearing, with the elastomeric bearing fixed on the top surface of a bridge pier, in order to secure an appropriate edge distance, a predetermined width of the elastomeric bearing is required. Also, in order to safely support the pier or elastomeric bearing, a predetermined width of the top surface of the pier is required. If the width of the elastomeric bearing for securing an edge distance and the width of the top surface of the pier for supporting the elastomeric bearing are unnecessarily increased, the overall width of the pier must be larger than is designed, which considerably increases the construction cost. Therefore, it is necessary to determine an appropriate width of the elastomeric bearing and an appropriate width of the top surface of the pier, that is, while obtaining an edge distance and ensuring safety.

In the case of supporting a beam or truss using the elastomeric bearing 100 shown in FIG. 8, the elastomeric bearing 100 must have a predetermined size in order to support a sufficiently high load. However, as described above, since the size of the elastomeric bearing 100 is increased, the length and width thereof are uniformly increased. Thus, as the width of the elastomeric bearing 100 becomes greater than a predetermined length for securing the edge distance, an unnecessary increase in the overall width of a pier is unavoidably caused, resulting in a waste of the construction cost, which causes a limitation in use.

Also, in the case of a bridge for vehicles, in particular, for railway vehicles, a dynamic force is applied to a beam of the bridge. Here, an elastomeric bearing for supporting the dynamic force is preferably constructed in view of safety such that buckling occurs in the axial direction of the bridge while suppressing buckling occurring at a right angle with respect to a longitudinal direction, that is, distortion of the beam. However, since the elastomeric pad 110 shown in FIG. 7 and the elastomeric bearing 100 shown in FIG. 8 are configured so as to allow buckling in every direction, a safety problem cannot be avoided.

SUMMARY OF THE INVENTION

To solve the above-described problem, it is an object of the present invention to provide an elastomeric bearing for supporting a high load by constricting expansion during compression, for enhancing safety due to unidirectional buckling, and for reducing the construction cost.

To accomplish the above object of the present invention, there is provided an elastomeric bearing for supporting a high load, having an upper plate, a lower plate and an elastomeric pad having a pair of sliding plates on its top surface and disposed between the upper and lower plates, wherein the elastomeric pad comprises: a cylinder member having a plurality of cylindrical hollows, elastomeric members seated on the respective cylindrical hollows of the cylinder member, a plurality of pistons inserted into the respective cylindrical hollows of the cylinder member to hermetically seal the elastomeric members seated thereon, and elasticity reinforcement elements integrally formed with the cylinder member and the plurality of pistons, for accommodating the same, the cylinder member having a plate-shaped body and a plurality of cylinders having cylindrical hollows formed therein, the plurality of cylinders protruding from the bottom of the body.

BRIEF DESCRIPTION OF THE DRAWINGS

The above object and advantages of the present invention will become more apparent by describing in de a preferred embodiment thereof with reference to the attached drawings in which:

FIGS. 2A through 2C are diagrams of an elastomeric pad shown in FIG. 1 according to a first embodiment of the present invention, in which FIG. 2A is a plan view of the elastomeric pad, FIG. 2B front sectional view of FIG. 2A and FIG. 2C is a side sectional view of FIG. 2A.

FIGS. 5A and 5B are diagrams of an elastomeric pad shown in FIG. 1 according to a second embodiment of the present invention, in which FIG. 5A is a plan view of the elastomeric pad and FIG. 5B is a front sectional view of FIG. 5A;

FIGS. 6A and 6B are diagrams of an elastomeric pad shown in FIG. 1 according to a third embodiment of the present invention, in which FIG. 6A is a plan view of the elastomeric pad and FIG. 6B is front sectional view of FIG. 6A;

DESCRIPTION OF THE PREFERRED EMBODIMENTS

Preferred embodiments of the present invention will now be described in detail with reference to the accompanying drawings.

Figure 1:
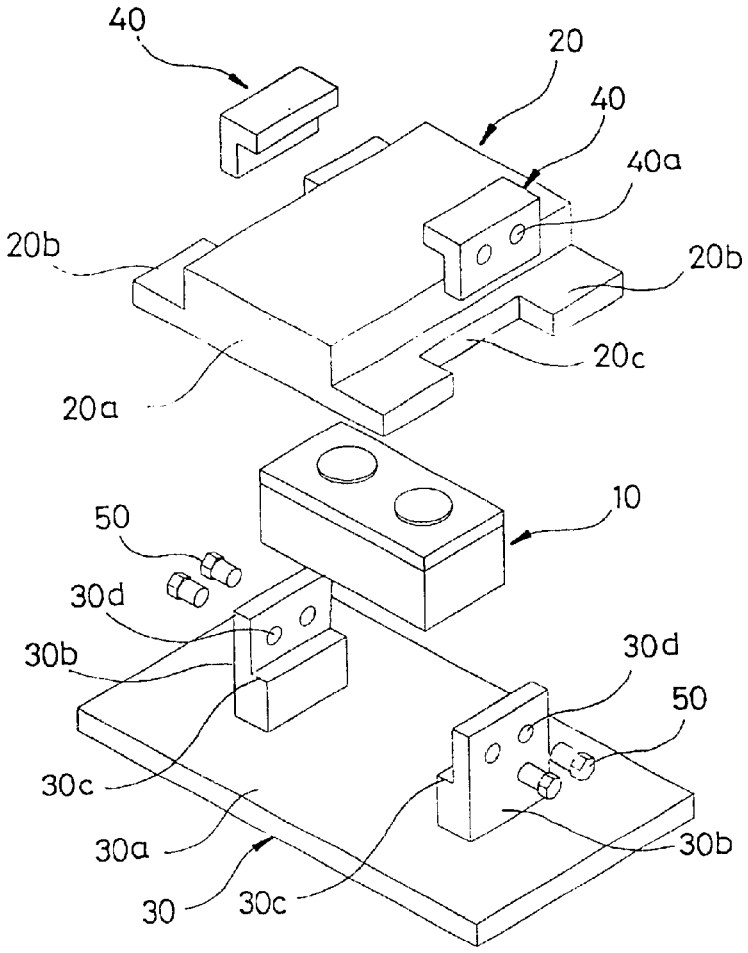
FIG. 1 an exploded perspective view of essential parts, illustrating an exemplary elastomeric bearing according to the present invention.

FIG. 1 is an exploded perspective view of essential parts, illustrating an exemplary elastomeric bearing according to the present invention. Referring to FIG. 1, the elastomeric bearing according to the present invention includes an upper plate 20, a lower plate 30 and an elastomeric pad 10 having sliding plates 13*a* and 13*b*(shown in FIG. 2*a*) disposed on its top surface, and the elastomeric pad 10 disposed between the upper and lower plates 20 and 30. The upper and lower plates 20 and 30 are configured so as to arbitrarily control the moving direction of the elastomeric pad 10.

First, the assembly procedure of various parts of the elastomeric bearing will be described with reference to FIG. 1. The sliding plates 13*a* and 13*b* are mounted between locking parts 30*b* of the lower plate 30, and a body 20*a* of the upper plate 20 is mounted on the sliding plates 13*a* and 13*b*. Here, slots 20*c* of plate portions 20*b* protruding at both sides of the body 20*a* substantially correspond to the locking parts 30*b* and a "]" shaped fixing piece 40 is inserted into the slot 20*c* of the upper plate 20 to be placed on a stepped portion 30*c* of the locking part 30*b*. In such a state, bolts 50 are fixedly inserted into the locking holes 30*d* of the locking parts 30*b* and locking holes 40*a* of the fixing pieces 40, the locking holes 30*d* being led to the locking holes 40*a*, so that the upper plate 20, the elastomeric pad 10 and the lower plate 20 are mutually connected so as to be operable.

The operation of the upper and lower plates 20 and 30 shown in FIG. 1 is known well. and will be described briefly. The operation of the upper and lower plates 20 and 30 in a longitudinal direction is controlled by adjusting the bridge-axial length of the slot 20*c* of the upper plate 20 and the bridge-axial length of the fixing piece 40. The operation of the upper and lower plates 20 and 30 in a direction at a right angle with respect to the longitudinal direction is controlled by adjusting the width of the slot 20*c* and the upward protrusion length of the fixing piece 40.

Figure 2A:
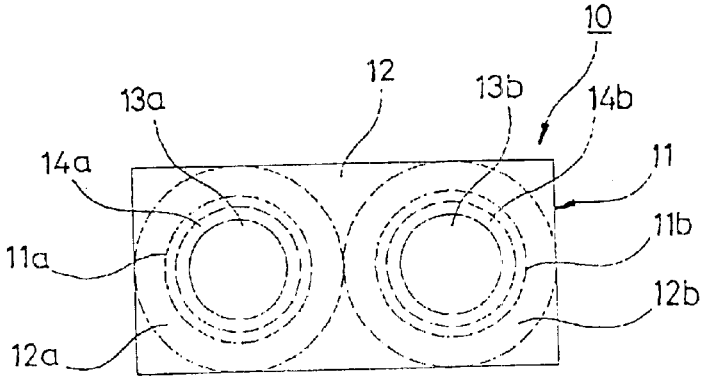
Figure 2B:
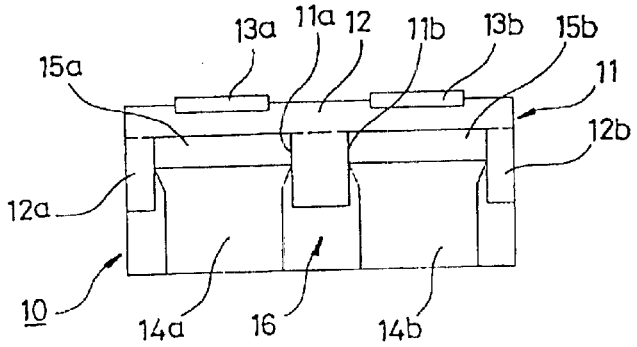
Figure 2C:
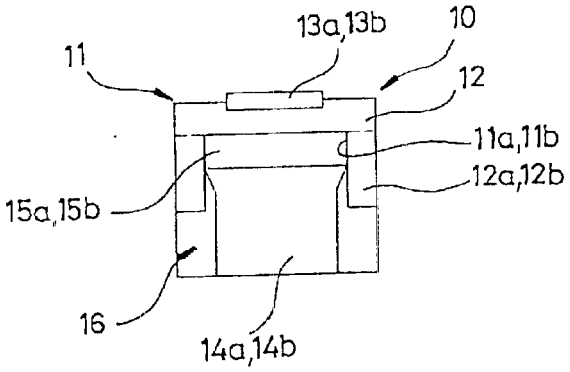

FIG. 2A is a plan view of an elastomeric pad according to a first embodiment of the present invention, FIG. 2B is a front sectional view of FIG. 2A and FIG. 2C is a side sectional view of FIG. 2A, and referring thereto, the elastomeric pad according to a first embodiment of the present invention includes a cylinder member 11 having a plurality of cylindrical hollows 11*a* and 11*b*, elastomeric members 15*a* and 15*b* seated on the respective cylindrical hollows 11*a* and 11*b* of the cylinder member 11, a plurality of pistons 14*a* and 14*b* inserted into the respective cylindrical hollows 11*a* and 11*b* of the cylinder member 11 to hermetically seal elastomeric members 15*a* and 15*b* seated thereon, and elasticity reinforcement elements 16 integrally formed with the cylinder member 11 and the plurality of pistons 14*a* and 14*b*, for accommodating the same. Here, the cylinder member 11 has a plate-shaped body 12, and a plurality of cylinders 12*a* and 12*b* having cylindrical hollows 11*a* and 11*b* formed therein and the plurality of cylinders 12*a* and 12*b* protruding from the bottom of the body 12.

Figure 3A:
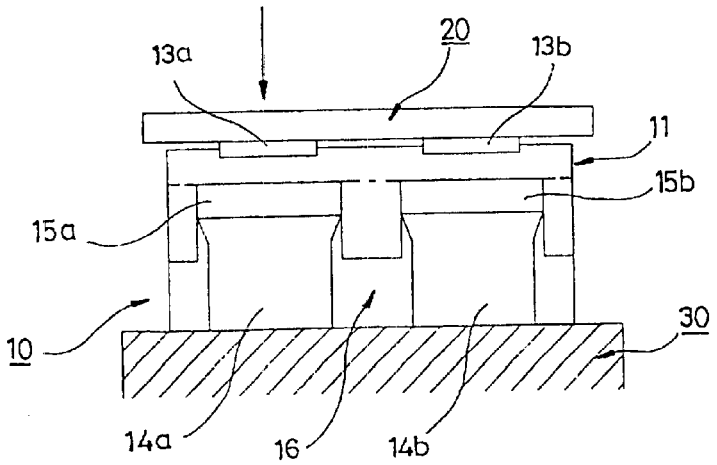
FIGS. 3A and 3B are diagrams illustrating states where a vertical load applied eccentrically in a direction crossing at a right angle with respect to the a longitudinal direction is applied to the elastomeric pad a shown in FIG. 2A, and where a vertical load applied eccentrically in a long direction is applied to the elastomeric pad shown in FIG. 2A.
Figure 3B:
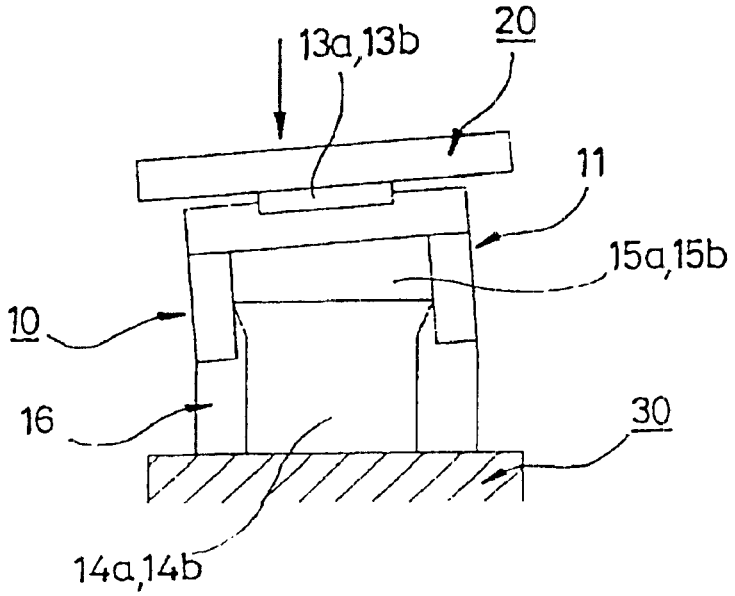

FIG. 3A is a diagram illustrating a state where a vertical load applied eccentrically in a direction at a right angle with respect to the longitudinal direction is applied to the elastomeric pad shown in FIG. 2A, and FIG. 3B is a diagram illustrating a state where a vertical load applied eccentrically in a longitudinal direction is applied to the elastomeric pad shown in FIG. 2A. As shown FIG. 3A, even if a vertical load applied eccentrically in a direction at a right angle with respect to the longitudinal direction, that is, in a direction indicated by an arrow, is applied to the elastomeric pad 10, the elastomeric pad 10 is not buckled. Also, as shown in FIG. 3B, if a vertical load applied eccentrically in a longitudinal direction is applied to the elastomeric pad 10, while the elasticity reinforcement element 16 of a side to which the vertical load is applied is compressed and the elasticity reinforcement element 16 of the opposite side is stretched, the cylinder member 11 is inclined by a predetermined angle toward a side to which the vertical load is applied, thereby causing. buckling.

Figure 4A:
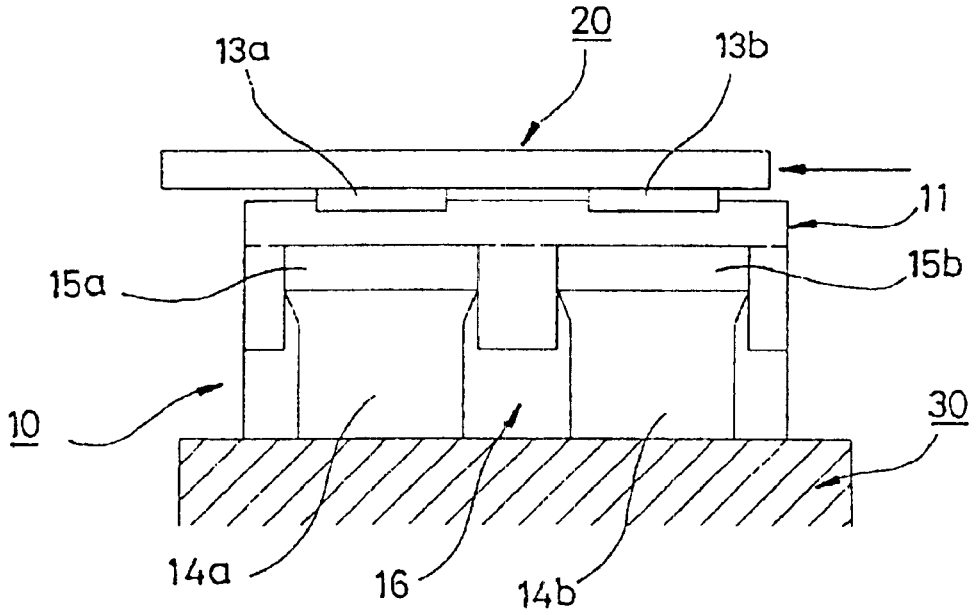
FIGS. 4A and 4B are diagrams illustrating states where a horizontal load applied eccentrically in a direction crossing at a right angle with respect to the a longitudinal direction is applied to the elastomeric pad shown in FIG. 2A, and where a horizontal load applied eccentrically in a longitudinal direction is applied to the elastomeric pad shown in FIG. 2A.
Figure 4B:
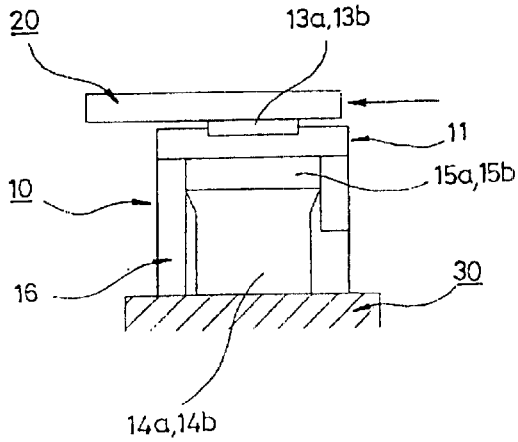

FIG. 4A is a diagram illustrating a state where a horizontal load applied eccentrically in a direction at a right angle with respect to the a longitudinal direction is applied to the elastomeric pad shown in FIG. 2A, and FIG. 4B is a diagram illustrating a state where a horizontal load applied eccentrically in a longitudinal direction is applied to the elastomeric pad shown in FIG. 2A. Referring to FIGS. 4A and 4B, the upper plate 20 is just placed on the sliding plates 13*a* and 13*b* fixed on the top surface of the elastomeric pad 10. Thus, even if a horizontal load is applied in any side, that is, either in a longitudinal direction or in a direction at a right angle with respect to the longitudinal direction, the upper plate 20 slidably moves relatively freely in a state where the elastomeric pad 10 stops.

Figure 5A:
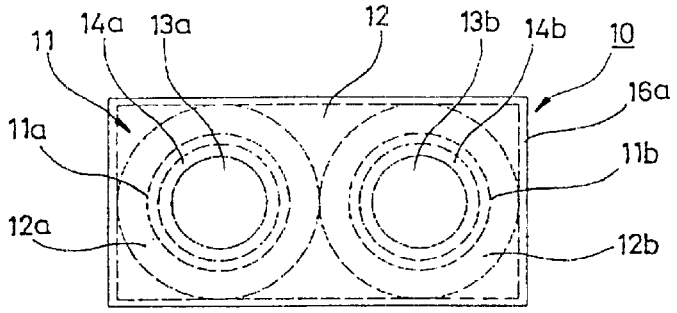
Figure 5B:
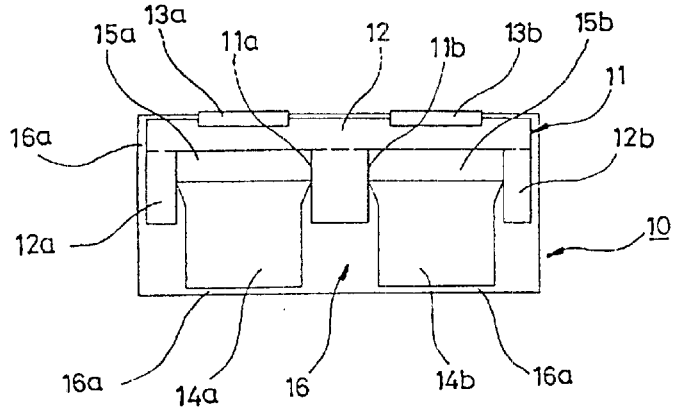

FIG. 5A is a plan view of an elastomeric pad shown in FIG. 1 according to a second embodiment of the present invention, and FIG. 5B is a front sectional view of FIG. 5A. Referring to FIGS. 5A and 5B, the reinforcement elements 16 enclosing the outer surfaces of the cylinder member 11 and the plurality of pistons 14*a* and 14*b* are integrally formed, therewith to be corrosion resistance portions 16*a*. As described above, the corrosion of the respective members made of metal can be prevented by enclosing the outer surfaces of the cylinder member 11 and the plurality of pistons 14*a* and 14*b*, thereby prolonging the service life of the product.

Figure 6A:
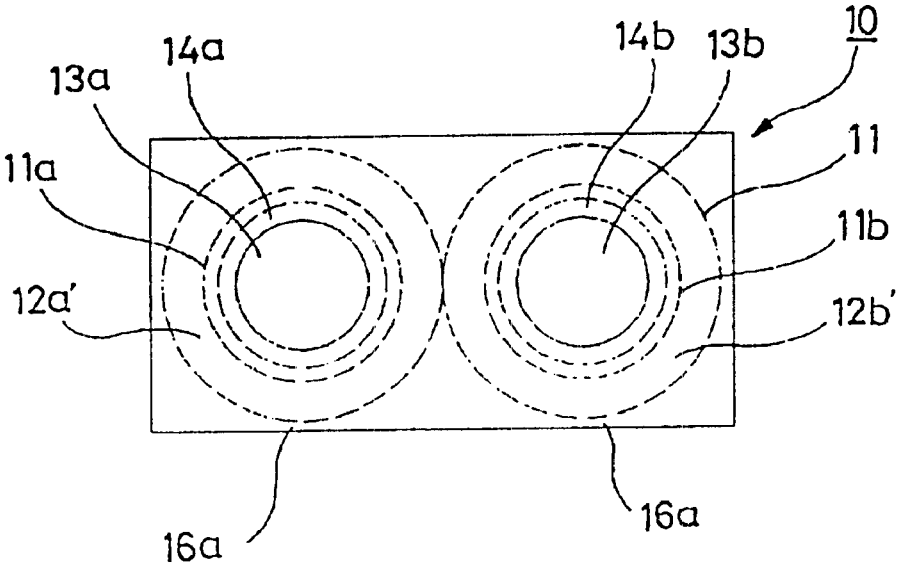
Figure 6B:
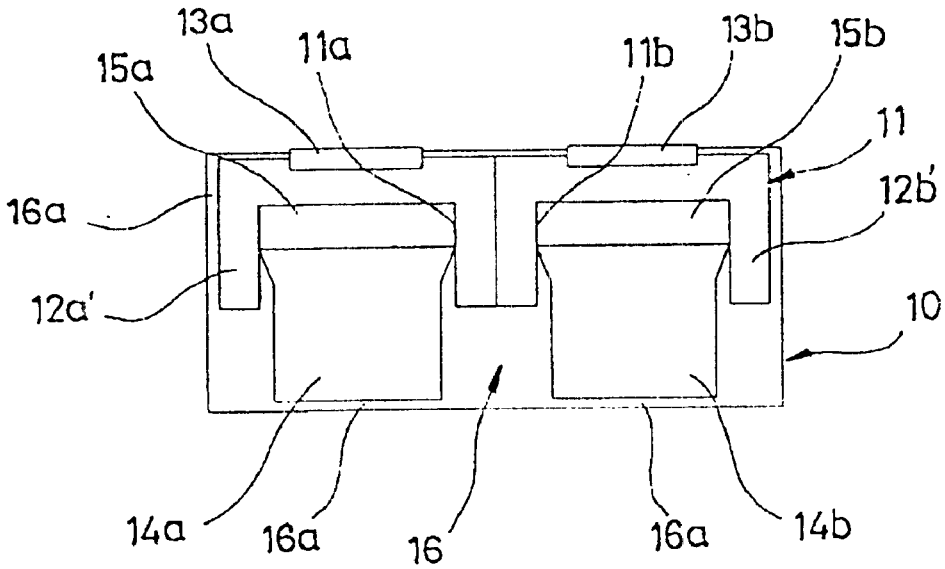
Figure 7:
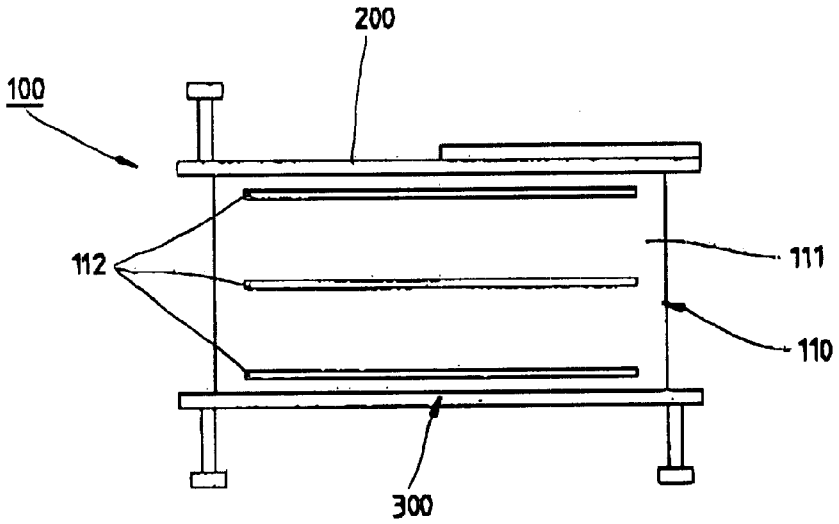
FIG. 7 PRIOR ART
FIG. 7 is a sectional view illustrating a conventional elastomeric bearing.
Figure 8:
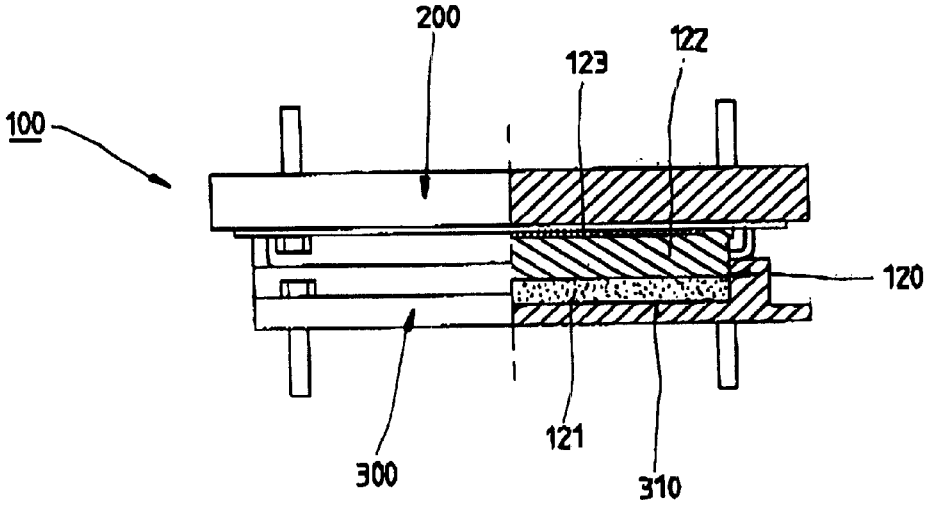
FIG. 8 PRIOR ART
FIG. 8 is a front sectional view illustrating another conventional elastomeric bearing.

FIG. 6A is a diagram of an elastomeric pad shown in FIG. 1 according to a third embodiment of the present invention, and FIG. 6B is a front sectional view of FIG. 6A. Referring to FIGS. 6A and 6B, the elastomeric pad 10 according to a third embodiment of the present invention includes a cylinder member 11 having a plurality of cylindrical hollows 11*a* and 11*b*, elastomeric members 15*a* and 15*b* seated on the respective cylindrical hollows 11*a* and 11*b* of the cylinder member 11, a plurality of pistons 14*a* and 14*b* inserted into the respective cylindrical hollows 11*a* and 11*b* of the cylinder member 11 to hermetically seal elastomeric members 15*a* and 15*b* seated thereon, and elasticity reinforcement elements 16 integrally formed with the cylinder member 11 and the plurality of pistons 14*a* and 14*b*, for accommodating the same. Here, the cylinder member 11 consists of a plurality of cylinders 12*a*' and 12*b*' having cylindrical hollows 11*a* and 11*b* formed therein.

The elastomeric pad 10 according to the third embodiment of the present invention has an advantage in that it has a reduced tare, compared to the elastomeric pad 10 according to the first embodiment of the present invention. However, in terms of wider application of the elasticity reinforcement elements 16, the elastomeric pad 10 according to the first embodiment is more preferred. For example, in the elastomeric pad 10 according to the first embodiment, since the body 12 of the cylinder member 11 is supported by the elasticity reinforcement elements 16, a higher vertical load can be supported than in the elastomeric pad according to the third embodiment.

In the elastomeric pad 10 according to the present invention, as described with reference to FIGS. 5A and 3B, buckling occurs smoothly in a longitudinal direction and no buckling occurs in a direction crossing at a right angle with respect to the longitudinal direction, which features the present invention and is not achieved by the prior art. Such a feature of the present invention allows the elastomeric pad 10 according to the present invention to be used as means for supporting a beam for a bridge for vehicles, in particular, for railway vehicles. In this case, it is expected that safety be greatly enhanced. Also, as illustrated through the above-described embodiments of the present invention, the width of the elastomeric pad 10 can be reduced as necessary, unlike the conventional elastomeric pad 110 or 120. Further, the elastomeric pad 10 according to the present invention can support a higher load than the conventional elastomeric pad 10 or 120, with the same supporting area.

As described above, according to the present invention, a higher load can be supported than in a conventional elastomeric bearing. Also, the safety of a bridge can be enhanced during construction thereof by an effect of preventing a turnover in a direction orthogonal to a longitudinal direction. Further, the width of the elastomeric bearing can be easily adjusted as desired, thereby reducing the construction cost. Also, the elastomeric bearing according to the present invention can be installed in various modified types, which improves its commercial values.

According to the present invention, since elasticity reinforcement elements accommodate a cylinder member and a plurality of cylinders, a separate sealing means is not necessary, while a sealing efficiency is further enhanced.

The present invention is not limited to the above-described elastomeric pad having a pair of cylindrical hollows and various alterations and modifications will become apparent within the scope and spirit of the present invention as defined in the appended claims.

What is claimed is:

1. An elastomeric bearing for supporting a high load, having an upper plate, a lower plate and an elastomeric pad having at least two sliding plates on its top surface and disposed between the upper and lower plates, wherein the elastomeric pad comprises:

a cylinder member having a plate-shaped body and at least two cylinders having cylindrical hollows formed therein, the cylinders protruding from the bottom of the body;

elastomeric members seated on the respective cylindrical hollows of the cylinder member;

at least two pistons inserted into the respective cylindrical hollows of the cylinder member to hermetically seal the elastomeric members seated thereon, and elasticity reinforcement element integrally formed with the cylinder member and the pistons, for accommodating and enclosing them.

* * * * *